US005726382A

United States Patent [19]

Scheffee et al.

[11] Patent Number: 5,726,382

[45] Date of Patent: Mar. 10, 1998

[54] EUTECTIC MIXTURES OF AMMONIUM NITRATE AND AMINO GUANIDINE NITRATE

[75] Inventors: Robert S. Scheffee; Brian K. Wheatley, both of Gainesville, Va.

[73] Assignee: Atlantic Research Corporation, Vienna, Va.

[21] Appl. No.: 508,350

[22] Filed: Jul. 28, 1995

Related U.S. Application Data

[63] Continuation-in-part of Ser. No. 414,470, Mar. 31, 1995, abandoned.

[51] Int. Cl.[6] ..... C06B 45/10; C06B 31/32; C06B 31/12

[52] U.S. Cl. ..... 149/19.91; 149/47; 149/62

[58] Field of Search ..... 149/17, 18, 19.91, 149/37, 46, 47, 61, 62, 88, 92; 280/728 R

[56] References Cited

U.S. PATENT DOCUMENTS

| | | | |
|---|---|---|---|
| 3,031,347 | 4/1962 | Philipson | 149/48 |
| 3,044,123 | 7/1962 | Grubaugh | 18/55 |
| 3,954,528 | 5/1976 | Chang et al. | 149/19.4 |
| 3,996,078 | 12/1976 | Klunsch | 149/2 |
| 4,111,728 | 9/1978 | Ramnarace | 149/19.5 |
| 4,600,452 | 7/1986 | Jessop et al. | 149/19.3 |
| 4,632,714 | 12/1986 | Abegg et al. | 149/2 |
| 4,722,757 | 2/1988 | Cooper et al. | 149/2 |
| 4,981,536 | 1/1991 | Bender | 149/35 |
| 5,024,160 | 6/1991 | Canterberry et al. | 102/323 |
| 5,071,630 | 12/1991 | Oberth | 423/266 |
| 5,292,387 | 3/1994 | Highsmith et al. | 149/19.1 |
| 5,336,439 | 8/1994 | Forsberg et al. | 252/356 |
| 5,411,615 | 5/1995 | Sumrail et al. | 149/47 |
| 5,451,277 | 9/1995 | Katzakian et al. | 149/19.92 |
| 5,531,941 | 7/1996 | Poole | 149/47 |
| 5,551,725 | 9/1996 | Ludwig | 280/737 |

FOREIGN PATENT DOCUMENTS

WO 95/09825 4/1995 Germany .

OTHER PUBLICATIONS

"Eutectic", Webster's II New Riverside University Dictionary, The Riverside Publishing Company (1994), p. 447.

"Eutectic", Hackh's Chemical Dictionary, McGraw-Hill Book Company, 4th Ed. (1969), p. 257.

"Eutectic", CRC Handbook of Chemistry and Physics, CRC Press, Inc. 63rd Ed. (1982), p. F-91.

"Eutectic", Hawley's Condensed Chemical Dictionary, Van Nostrand Reinhold Company, 11th Ed. (1987), p. 502.

*Primary Examiner*—Joseph D. Anthony

*Attorney, Agent, or Firm*—Lowe, Price, LeBlanc & Becker

[57] ABSTRACT

A eutectic solution of ammonium nitrate and either aminoguanidine nitrate (AGN) or guanidine nitrate (AN) in the form of a present pellet is used to generate a particulate-free, non-toxic, odorless and colorless gas that is useful wherever an immediate source of such gas is required, such as the inflation of an occupant restraint air bag. The use of the material in the form of a eutectic totally eliminates pellet cracking. Moreover, the addition of a minor amount of potassium nitrate to the eutectic solution eliminates the ammonium nitrate phase change due to temperature cycling without adversely affecting the pressed pellets' freedom from cracking due to said temperature cycling.

11 Claims, 6 Drawing Sheets

FIG. 5

AGN/AN PROPELLANT
EXHAUST GAS ANALYSIS (60 LITER TANK)

| | ANALYSIS (ppm) | GM Spec (ppm) |
|---|---|---|
| NO | 7.5 | 532 |
| $NO_2$ | 3.5 | 107 |
| $NH_3$ | 3.0 | 1,596 |
| HCN | <2.5 | 266 |
| $H_2CO$ | <0.2 | 107 |
| CO | 530 | 4,788 |
| $CO_2$ | 1,300 | 399,000 |

EUTECTIC MIXTURES OF AMMONIUM NITRATE AND AMINO GUANIDINE NITRATE

This application is a continuation in part of application Ser. No. 08/414,470 filed Mar. 31, 1995 now abandoned.

FIELD OF THE INVENTION

The present invention relates to a eutectic solution-forming mixture of ammonium nitrate (AN) and either aminoguanidine nitrate (AGN) or guanidine nitrate (GN) and optionally potassium nitrate (KN) that will generate a particulate-free, non-toxic, odorless and colorless gas, for various purposes, such as inflating a vehicle occupant restraint, i.e., an air bag for an automotive vehicle.

BACKGROUND OF THE INVENTION

The present invention relates generally to solid composite propellant compositions and more particularly to solid composite propellant compositions useful as gas generators.

Recently, there has been a great demand for new gas generating propellants which are cool burning, non-corrosive and yield a high volume of gas and low solid particulates because attempts to improve existing gas generating compositions have been unsuccessful for various reasons. For example, while the addition of certain modifiers has lowered the flame temperature and increased gas production, these same modifiers have contributed to the production of undesirable corrosive products. In turn, other modifiers utilized in the past, while not producing corrosive materials, have not succeeded in lowering the flame temperature significantly or of increasing gas evolution.

The usual gas generator composition, known in gas generator technology as the "propellant", is comprised of ammonium nitrate oxidizer with rubbery binders or in pressed charges. Various chemicals such as guanidine nitrate, oxamide and melamine are used in the propellant to aid ignition, give smooth burning, modify burning rates and give lower flame temperatures.

Ammonium nitrate is the most commonly used oxidizer since it is exceptionally effective per unit weight and yields a non-toxic and non-corrosive exhaust at low flame temperatures. Further, it contributes to burning rates lower than those of other oxidizers. Ammonium nitrate is cheap, readily available and safe to handle. The main objection to ammonium nitrate is that it undergoes certain phase changes during temperature variations causing cracks and voids if any associated binder is not sufficiently strong and flexible to hold the composition together.

Ammonium nitrate compositions are hygroscopic and difficult to ignite, particularly if small amounts of moisture have been absorbed. Since said compositions do not sustain combustion at low pressures, various combustion catalysts are added to promote ignition and low pressure combustion as well as to achieve smooth, stable burning. Gas generator compositions used for air bags should contain no metallic additives or even oxidizers such as ammonium perchlorate, because these give erosive and corrosive exhaust gases respectively. Commonly used additives, such as ammonium dichromate, copper chromite, etc., are disadvantageous since they all produce solids in the exhaust gases.

Gas generator compositions are usually manufactured by a pressing or by an extruding and compression molding technique. The solid particles are formed and the composition is broken up into bits ("granulated") with appropriate granulator-type equipment.

After granulation, the composition is loaded into molds of the required shapes and pressed to about 7000 psi (4921 kg/cm$^2$). With certain types of binder, the molds are heated to about 180° F. (82° C.) until the composition is cured or vulcanized. The grain is then potted into the gas generator cases. The molds, mills and extrusion equipment are costly; the lengthy process time further increases the cost of manufacture. It is especially difficult to produce large grains by this technique.

The art is replete with instances of compositions containing a guanidine-type compound together with an oxidizer, such as ammonium nitrate. For example, in U.S. Pat. No. 3,031,347, guanidine nitrate and ammonium nitrate are listed together at column 2, as well as in Examples 3 and 5. However, compared with the present invention, not only does the guanidine compound lack an amino group, as in the aminoguanidine nitrate embodiment, but the composition disclosed in the patent is not a eutectic solution-forming mixture. Likewise, see U.S. Pat. No. 3,739,574, col. 2, in the Table. On the other hand, U.S. Pat. No. 3,845,970, at column 3, discloses a list of solid compositions for generating gas in a shock absorption system. Among the components of the various compositions are ammonium nitrate and aminoguanidine nitrate. The two materials are not disclosed in admixture and, obviously, are not in a eutectic composition.

Similarly, U.S. Pat. No. 3,954,528, discloses new solid composite gas generating compositions. Among the ingredients mentioned are ammonium nitrate and triaminoguanidine nitrate. See Examples 2 through 5. However, neither the specific components of the aminoguanidine nitrate compositions at hand, nor any eutectic compositions, are disclosed therein.

In U.S. Pat. No. 4,111,728, the inventor discloses ammonium nitrate with small amounts of guanidine nitrate. See column 2 and the table at columns 3–4. However, the compositions do not include aminoguanidine nitrate and do not characterize any composition as forming a eutectic solution.

U.S. Pat. No. 5,125,684 also discloses propellant compositions containing dry aminoguanidine nitrate and an oxidizer salt containing a nitrate anion. However, the disclosure is deficient with respect to the present invention since it fails to disclose the specific combination of components of the present invention and does not mention eutectics.

Finally, U.S. Pat. No. 5,336,439 concerns salt compositions and concentrates used in explosive emulsions. As disclosed at columns 37 and 38, ammonium nitrate is one of the ingredients for forming the patentee's composition, while at column 20, line 51, aminoguanidine is indicated as also being an appropriate component. Nevertheless, like the other disclosures mentioned, the patent fails to disclose a specific composition including the same nitrates as are disclosed herein and clearly does not teach a eutectic composition containing said components.

SUMMARY OF THE INVENTION

The present invention involves eutectic mixtures of ammonium nitrate and guanidine nitrate (GN) or aminoguanidine nitrate, as well as a method of generating a particulate-free, non-toxic, odorless and colorless gas for various purposes, such as to inflate an air bag in an automotive vehicle. In generating a particulate-free, non-toxic, odorless and colorless gas, an enclosed pressure chamber having an exit port is provided; a solid eutectic solution comprising ammonium nitrate and either aminoguanidine nitrate or guanidine nitrate (GN) is disposed within said chamber; means are then provided for igniting said eutectic solution in response to a sudden deceleration being detected by a detection device in the pressure chamber, whereby gas is instantly generated and conducted through the exit port of the pressure chamber to accomplish a desired function, such as inflating an automotive vehicle air bag.

Eutectic mixtures of ammonium nitrate and aminoguanidine nitrate or guanidine nitrate, it has been found, eliminate pellet cracking and substantially reduce ammonium nitrate phase change due to temperature cycling. Moreover, the addition of up to about 10% potassium nitrate (KN) to the noted eutectic stabilizes the ammonium nitrate (AN), totally eliminates the ammonium nitrate phase change and maintains the freedom from cracking of the pressed pellet upon temperature cycling.

DESCRIPTION OF THE PREFERRED EMBODIMENT

To achieve the advantages of employing ammonium nitrate, e.g., low cost, availability and safety, while avoiding its drawbacks, e.g., cracks and voids in the pressed pellet when subjected to temperature cycling, it is proposed to mix the ammonium nitrate oxidizer with aminoguanidine nitrate or guanidine nitrate and then form a eutectic solution which avoids some of the problems previously encountered and discussed above. Thus, the provision of the ammonium nitrate/aminoguanidine nitrate or the AN/GN as a eutectic in the form of a pressed pellet provides a generator to produce a particulate-free, non-toxic, odorless, and colorless gas for inflating an air bag, but without the tendency of the pellet to crack and with reduced phase change of the AN due to temperature cycling. Also, to some degree, the hygroscopicity of the mixture is reduced. By the addition of small amounts of potassium nitrate, such as up to about 10% by weight, freedom from cracking of the pressed pellet upon temperature cycling is still maintained and the phase change of the AN is completely eliminated.

When equal parts of ammonium nitrate and aminoguanidine nitrate are melted together, a low-melting point solution is formed. The respective melting points are 169°, 148° and 108° C. for ammonium nitrate, aminoguanidine nitrate and the 50/50 mixture thereof, respectively.

When 33 grams of 50/50 ammonium nitrate/aminoguanidine nitrate are fixed with 159 grams of argon in a 60-mm (diameter) gas generator for a passenger side air bag, the pressure in a 60-liter tank is 84 psi. The effluent is particulate-free, non-toxic, odorless and colorless.

In addition, it has been discovered that the same eutectic employed to generate the gases may also be used as the igniter in the inflator device. By so utilizing the same eutectic for igniting the propellant, the inventors are able to eradicate the smoke that would otherwise be present in the exhaust. For the igniter load, the eutectic is provided as a powder, granulate, monolithic composite or any other form that may conveniently be disposed in the generator.

In some cases, small amounts (up to about 5% by weight) of polyvinyl alcohol (PVA), as binder, are employed in the foregoing compositions. Also, to increase the stabilization of the ammonium nitrate, up to about 5% by weight of zinc oxide (ZnO) may be added to the compositions. By employing combinations of potassium nitrate and zinc oxide, one may achieve stability at temperatures up to 107° C.

THE DRAWINGS

Figure 1:
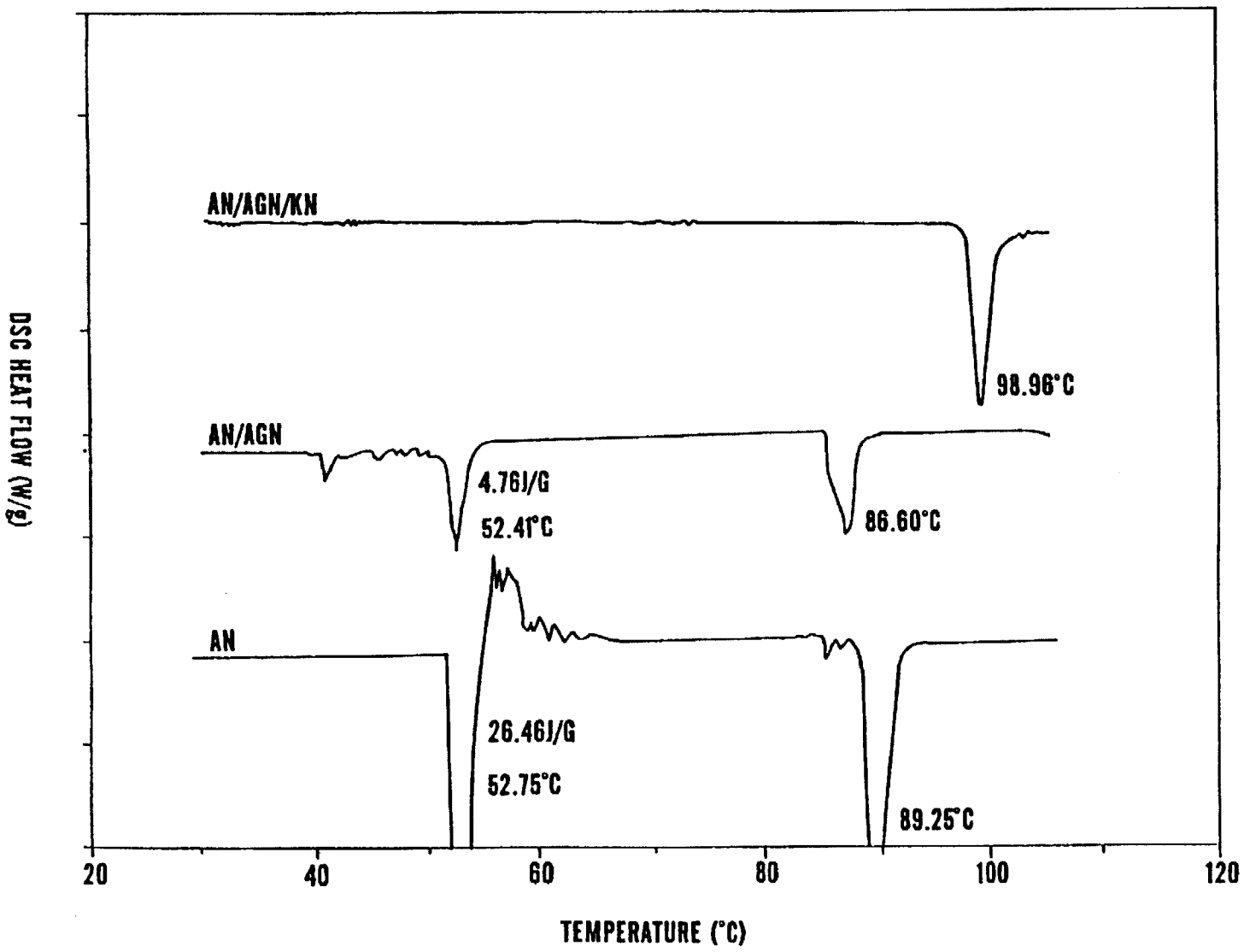

To demonstrate the effectiveness of the present propellant system, attention is invited to FIG. 1 of the present drawings, wherein DSC heat flow (W/g) produced by ammonium nitrate (AN) and ammonium nitrate/aminoguanidine nitrate eutectic (AN/AGN) and of a mixture of AN, AGN and potassium nitrate (KN) are compared. It will be observed that the three component composition provides a uniform heat flow up to 98.96° C. On the other hand, the two component composition dips sightly at 52.41° C. and then continues to 86.60° C. The ammonium nitrate, by itself, exhibits a precipitous drop at 52.75° C., followed by a slight increase and a second drop at 89.25° C.

Figure 2:
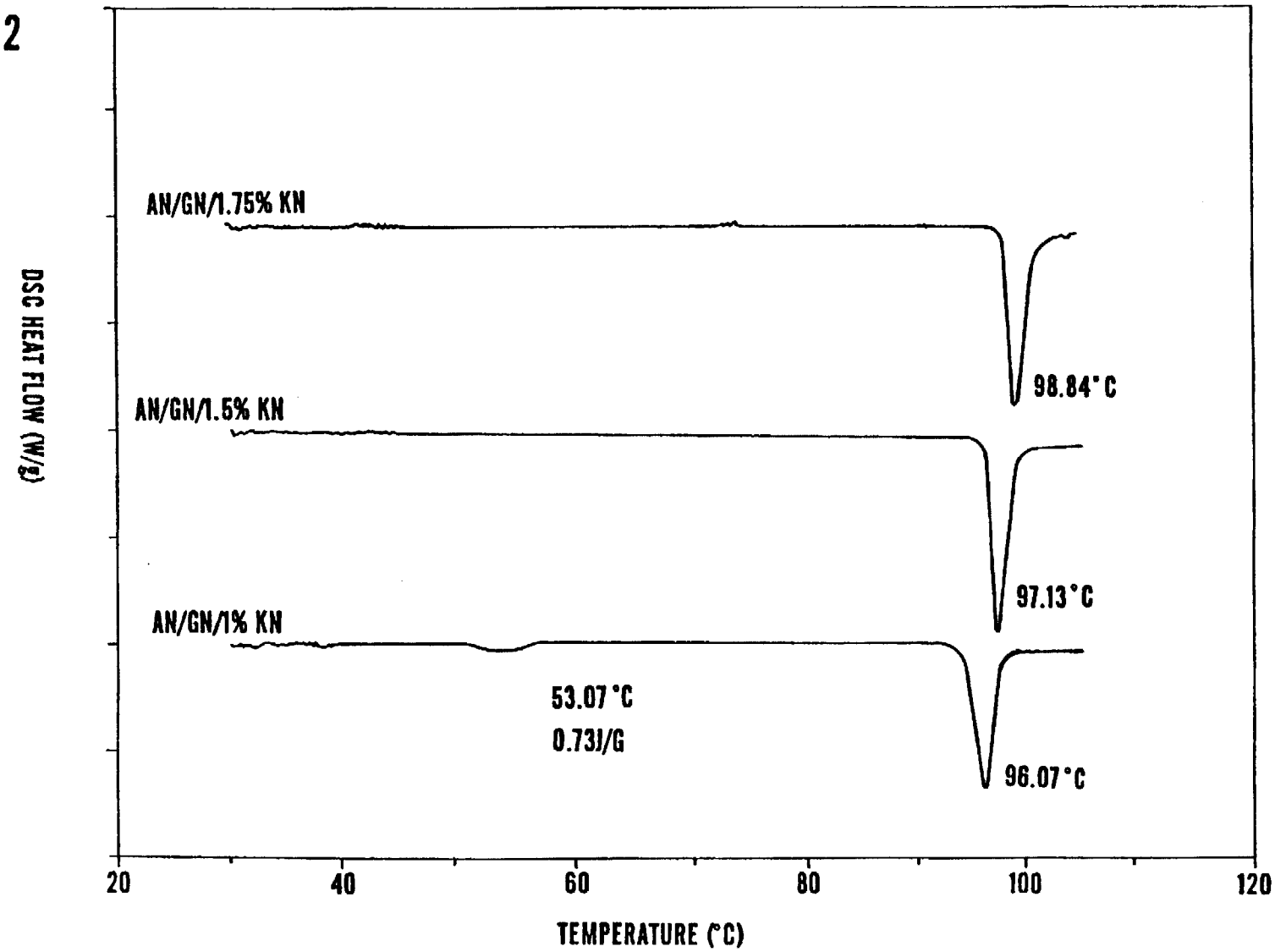

In FIG. 2, small variations in the concentration of potassium nitrate in AN/GN/KN compositions are compared. At 1% KN, the composition exhibits a small decline at 53.07° C. and continues without any major variations until 96.07° C. On the other hand, when the concentration of potassium nitrate is increased to 1.5%, the heat flow continues at a constant rate until 97.13° C. By increasing the concentration of potassium nitrate to 1.75%, the inventors extend the uniform heat flow until 98.84°.

Figure 3:
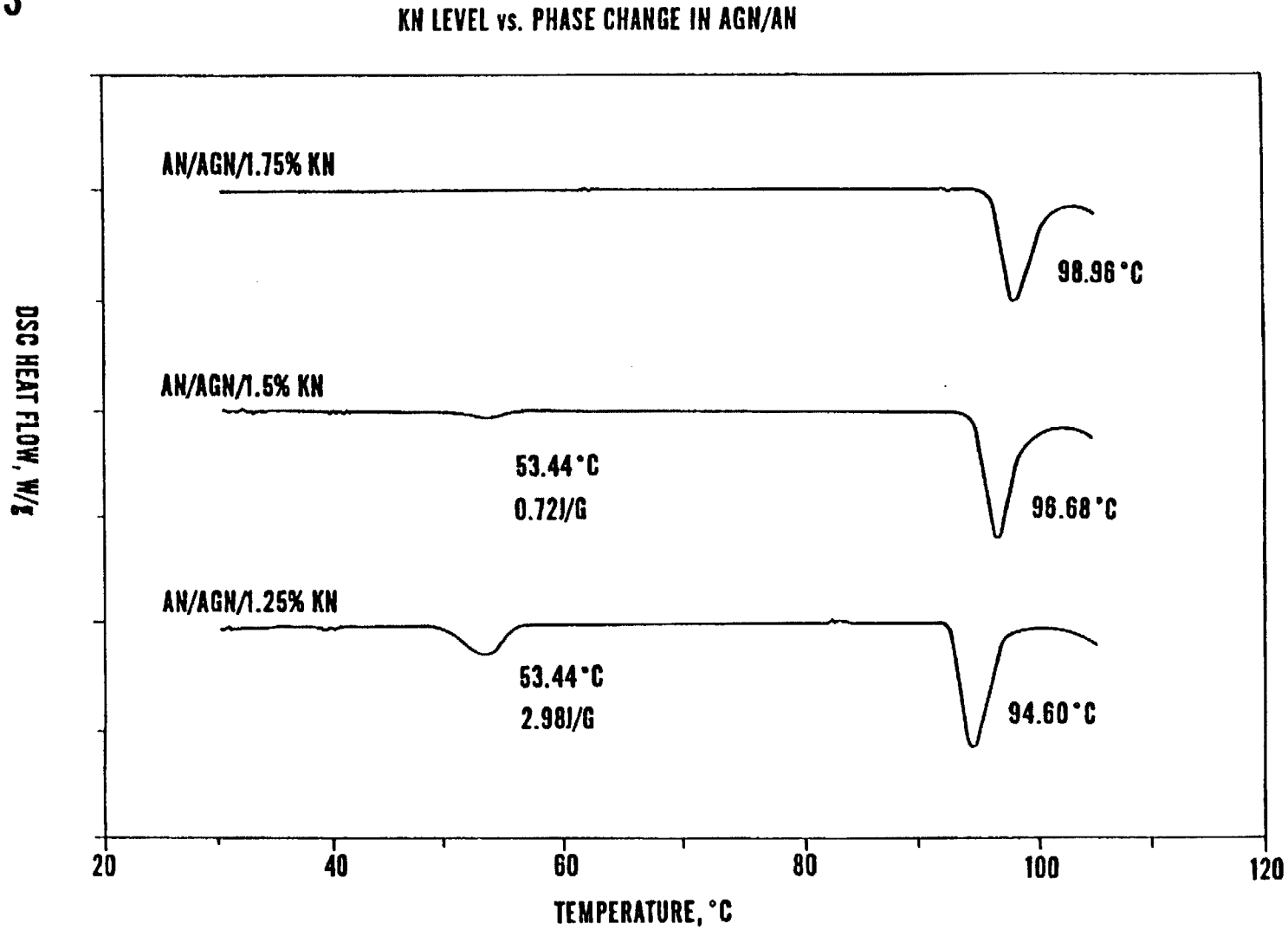

In a further comparison, similar to that shown in FIG. 2, but with AGN instead of GN, FIG. 3 shows essentially the same pattern of heat flow. Although greater differences are reported between compositions containing 1.75% KN, as opposed to compositions containing 1.5% KN and 1.25% KN, compared with the results in FIG. 2, the overall graph represents essentially the same type of data.

Figure 4:
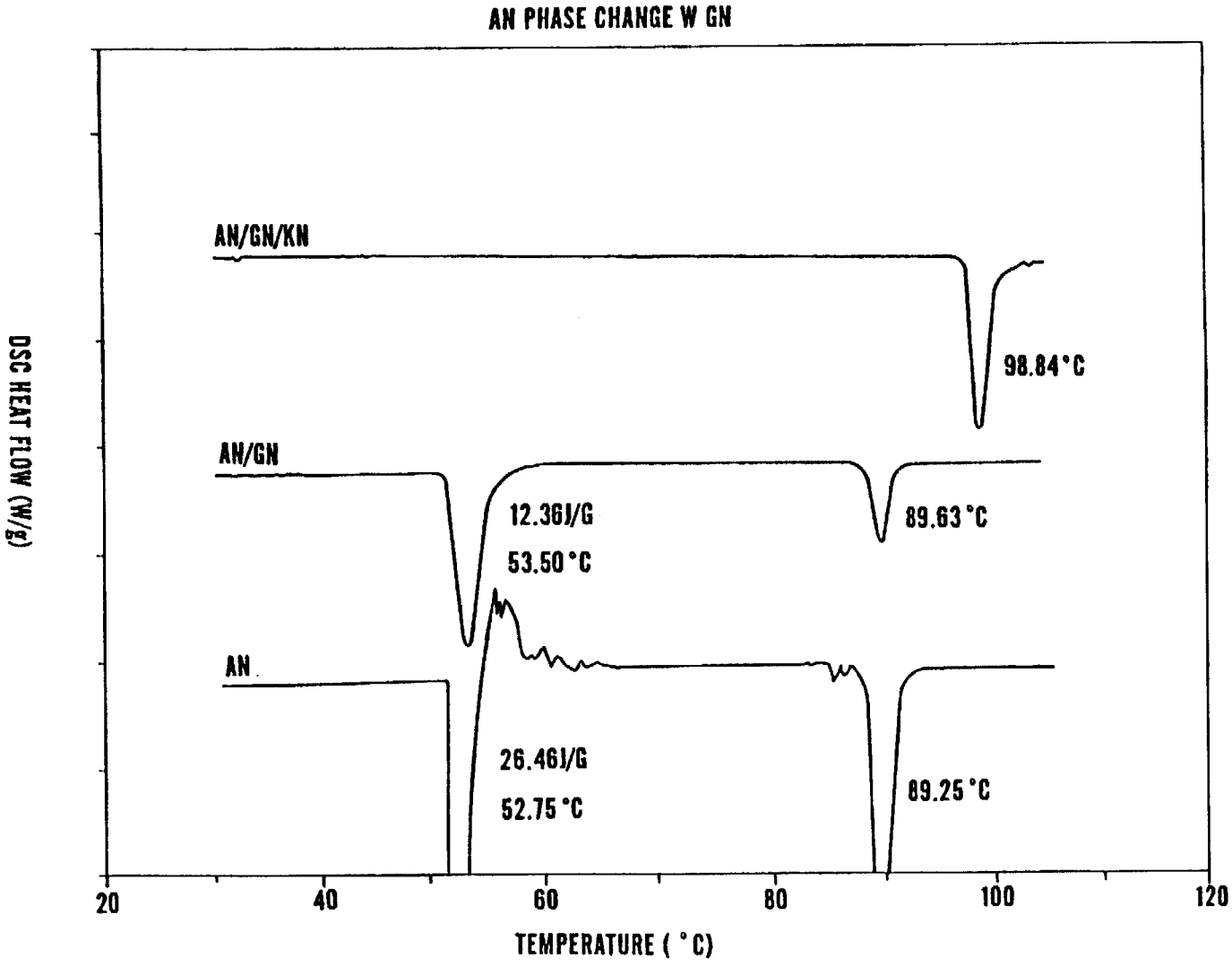

FIG. 4 represents a comparison like that of FIG. 1, but exemplifying the phase change of a guanidine nitrate/ammonium nitrate (GN/AN) composition, instead of an AGN/AN composition. Although the specific values for the depressions vary somewhat, the overall results follow the same pattern shown for the corresponding composition containing the aminoguanidine nitrate, instead of guanidine nitrate, as here.

FIG. 5 provides an analysis of the exhaust gas provided by an aminoguanidine nitrate/ammonium nitrate propellant. The exhaust gas is collected in a 60 liter tank and indicates 1300 ppm of carbon dioxide, with a smaller amount of 530 ppm of carbon monoxide. The exhaust gas also contains small amounts of hydrogen cyanide, formaldehyde, ammonia and nitrogen oxides.

Figure 6:
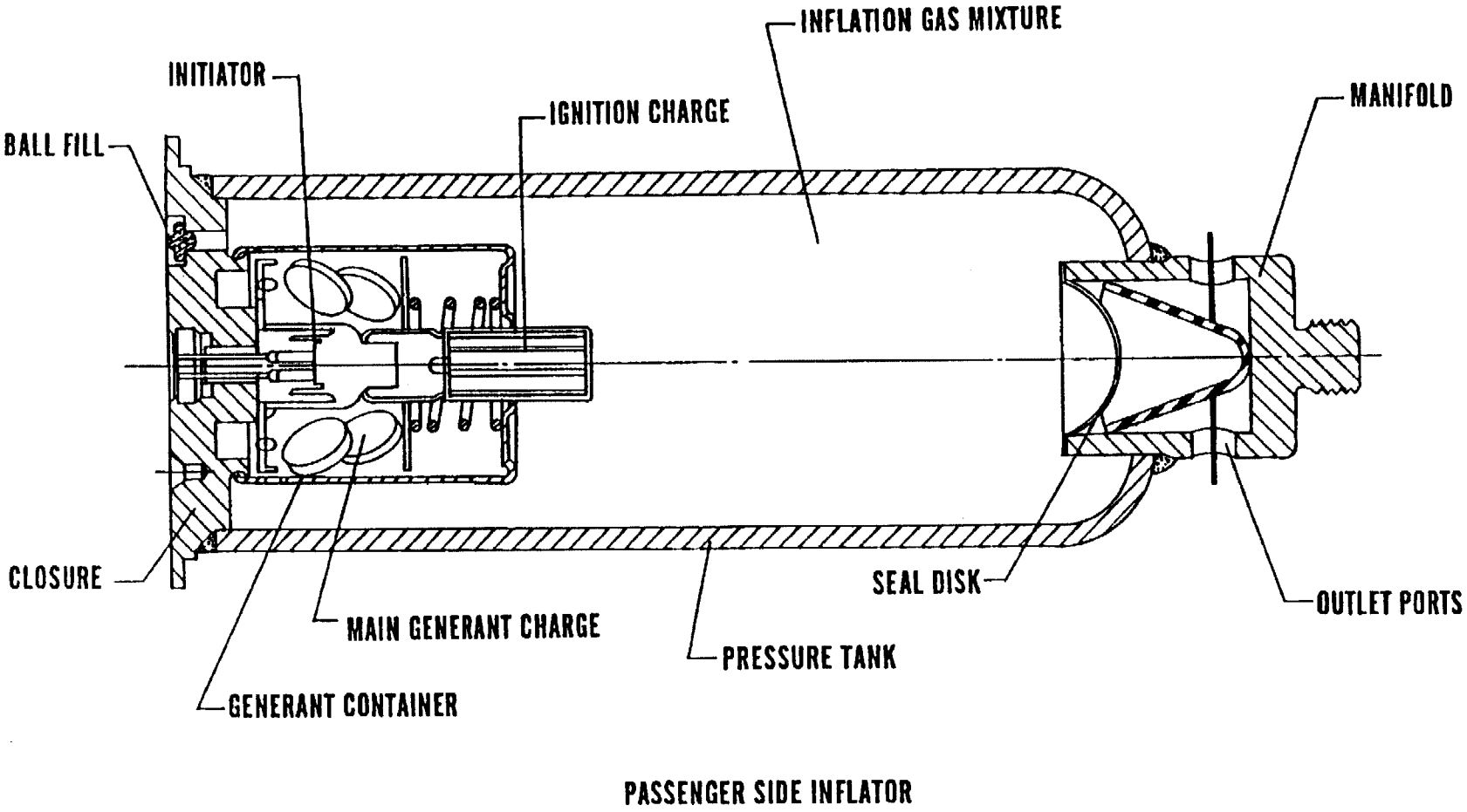

In FIG. 6, conventional apparatus for use in the generation of gas to inflate an automotive vehicle air bag is depicted. As is readily seen from the drawing, the outlet ports are provided at the extreme right of the device.

The following formulations within the scope of the instant invention provide very good results:

EXAMPLE 1

47% by weight guanidine nitrate;
47% by weight ammonium nitrate;
3% by weight potassium nitrate; and
3% by weight zinc oxide

EXAMPLE 2

47.5% by weight guanidine nitrate;
47.5% by weight ammonium nitrate; and
5% by weight zinc oxide

EXAMPLE 3

31.3% by weight guanidine nitrate;
54.2% by weight ammonium nitrate;
9.5% by weight potassium nitrate; and
5% by weight polyvinyl alcohol

EXAMPLE 4

40% by weight guanidine nitrate;
53.5% by weight ammonium nitrate;

1.5% by weight potassium nitrate; and
5% by weight polyvinyl alcohol.

The most preferred formulations, based upon present testing, are those of Examples 3 and 4. However, it is contemplated that other formulations containing the disclosed eutectic composition, together with one or both stabilizers and optionally a binder, such as polyvinyl alcohol binder, will also prove to be of equivalent efficacy. Likewise, corresponding results are expected from compositions in which guanidine nitrate is replaced with a counterpart amount of aminoguanidine nitrate.

Only the preferred embodiment of the invention and a few examples of its versatility are shown and described in the present disclosure. It is to be understood that the invention is capable of use in various other combinations and environments and is capable of changes or modifications within the scope of the inventive concept as expressed herein.

Additional objects and advantages of the present invention will become readily apparent to those skilled in this art from the description. As will be realized, the invention is capable of other and different embodiments, and its several details are capable of modifications in various obvious respects, all without departing from the invention. Accordingly, the drawings and description are to be regarded as illustrative in nature, and not as restrictive.

We claim:

1. A composition for generating a substantially particulate-free, non-toxic, odorless and colorless gas comprising:

a eutectic solution of ammonium nitrate and either aminoguanidine nitrate or guanidine nitrate, together with a minor amount of potassium nitrate, a polyvinyl alcohol binder and an optional amount of zinc oxide.

2. The composition of claim 1 wherein the mixture comprises equal parts by weight of ammonium nitrate and either aminoguanidine nitrate or guanidine nitrate.

3. The composition of claim 1 wherein the mixture comprises 40% to 60% by weight of ammonium nitrate and 40% to 60% by weight of either aminoguanidine nitrate or guanidine nitrate.

4. The eutectic solution of claim 1 in the form of a pressed pellet which is resistant to cracking when subjected to temperature cycling.

5. The composition according to claim 1, also including up to 5% by weight zinc oxide.

6. The composition according to claim 1, comprising equal parts of guanidine nitrate and ammonium nitrate and equal parts of potassium nitrate and zinc oxide.

7. The composition according to claim 1 consisting of:

a) 31.3% by weight guanidine nitrate;

b) 54.2% by weight ammonium nitrate; and c) 9.5% by weight potassium nitrate; and d) 5% by weight polyvinyl alcohol.

8. The composition according to claim 1 consisting of:

a) 40% by weight guanidine nitrate;

b) 53.5% by weight ammonium nitrate;

c) 1.5% by weight potassium nitrate; and d) 5% by weight polyvinyl alcohol.

9. The composition of claim 1 wherein the amount of potassium nitrate present is up to 10% by weight.

10. The composition of claim 9 wherein the potassium nitrate is present in the range of about 1 to about 2% by weight.

11. The composition according to claim 9, also including up to 5% by weight zinc oxide.

* * * * *